US009725261B2

(12) United States Patent
Mizuguchi

(10) Patent No.: US 9,725,261 B2
(45) Date of Patent: Aug. 8, 2017

(54) CONVEYANCE UNIT AND IMAGE FORMING APPARATUS INCLUDING THIS

(71) Applicant: KYOCERA Document Solutions Inc., Osaka (JP)

(72) Inventor: Keisuke Mizuguchi, Osaka (JP)

(73) Assignee: KYOCERA Document Solutions Inc., Osaka (JP)

( * ) Notice: Subject to any disclaimer, the term of this patent is extended or adjusted under 35 U.S.C. 154(b) by 0 days.

(21) Appl. No.: 15/064,978

(22) Filed: Mar. 9, 2016

(65) Prior Publication Data

US 2016/0264367 A1 Sep. 15, 2016

(30) Foreign Application Priority Data

Mar. 13, 2015 (JP) ..... 2015-050333

(51) Int. Cl.

| | |
|---|---|
| ***B65H 1/10*** | (2006.01) |
| ***B65H 1/12*** | (2006.01) |
| ***B65H 1/26*** | (2006.01) |
| ***B65H 3/06*** | (2006.01) |

(Continued)

(52) U.S. Cl.

CPC ..... *B65H 1/12* (2013.01); *B65H 1/266* (2013.01); *B65H 3/0607* (2013.01); *B65H 3/0669* (2013.01); *B65H 3/565* (2013.01); *G03G 15/6502* (2013.01); *G03G 15/6511* (2013.01); *B65H 2403/512* (2013.01); *B65H 2403/514* (2013.01); *B65H 2403/5332* (2013.01);

(Continued)

(58) Field of Classification Search

CPC ... B65H 1/08; B65H 1/12; B65H 1/14; B65H 1/26; B65H 1/266; B65H 2403/51; B65H 2403/512; B65H 2403/514; B65H 2403/5332; B65H 2405/111; B65H 2405/1117; B65H 2405/11171; B65H 3/0607; B65H 3/0669; B65H 3/565; B65H 2601/322

See application file for complete search history.

(56) References Cited

U.S. PATENT DOCUMENTS 8,794,618 B2 * 8/2014 Kondo ..... B65H 3/0607 271/152
2008/0101837 A1 * 5/2008 Cho ..... B65H 1/12 399/393

(Continued)

FOREIGN PATENT DOCUMENTS

JP 2012-218846 A 11/2012

*Primary Examiner* — Prasad Gokhale
(74) *Attorney, Agent, or Firm* — Studebaker & Brackett PC

(57) ABSTRACT

A conveyance unit includes a cassette removably attached to an apparatus body and a conveyance interlocked part provided in the apparatus body. The cassette includes a sheet storage part for storing a sheet, a lift plate liftably provided between a lowered position and a raised position and a biasing member for biasing the sheet to contact with a pickup roller. The conveyance interlocked part includes a lever for engaging with the lift plate when the cassette is attached to the apparatus body and being liftable together with the lift plate, a pressing mechanism for pressing the lever downward, and a support member provided between the apparatus body and the lever so as to suppress a drop of the lever disengaged from the lift plate when the cassette is detached from the apparatus body.

8 Claims, 11 Drawing Sheets

(51) Int. Cl.
*B65H 3/56* (2006.01)
*G03G 15/00* (2006.01)

(52) U.S. Cl.
CPC ..... *B65H 2405/11171* (2013.01); *B65H 2601/322* (2013.01)

(56) References Cited

U.S. PATENT DOCUMENTS

2012/0242033 A1* 9/2012 Hayashi ..... B65H 3/0607 271/109
2013/0154184 A1* 6/2013 Shin ..... B41J 13/103 271/267
2013/0168920 A1* 7/2013 Shin ..... B65H 3/0607 271/117
2015/0276808 A1* 10/2015 Teranishi ..... H01R 13/2407 324/755.07
2015/0298932 A1* 10/2015 Mizuno ..... B65H 7/20 271/3.19

* cited by examiner

CONVEYANCE UNIT AND IMAGE FORMING APPARATUS INCLUDING THIS

INCORPORATION BY REFERENCE

This application is based on and claims the benefit of priority from Japanese Patent application No. 2015-50333 filed on Mar. 13, 2015, the entire contents of which are incorporated herein by reference.

BACKGROUND

The present disclosure relates to a conveyance unit preferably applied in a copying machine or a printer or the like and an image forming apparatus including this.

An image forming apparatus such as a copier and a printer includes a conveyance unit bringing an uppermost sheet of a stacked sheet bundle into pressure contact with a sheet feed roller to convey the sheet.

For instance, a sheet feed unit (a conveyance unit) includes a lift plate provided liftably within a sheet feed cassette, a coil spring for biasing the lift plate upward, and a hook-like eccentric cam for pressing down the lift plate by resisting against a bias force of the coil spring. The eccentric cam is fixed to a shaft and is rotationally driven in one direction. The eccentric cam controls the lift of the lift plate by coming in sliding contact with a cam follower attached to the lift plate. When no sheet is fed, the eccentric cam is located at a reference position and pushes down the lift plate to a vicinity of a lowest point.

However, the conveyance unit described causes the following trouble in attaching the sheet feed cassette. That is, when the sheet feed cassette is drawn out of the apparatus body to replenish sheets for example, the eccentric cam is disengaged from the cam follower and turns in one direction from the reference position. When the sheet feed cassette is attached in this state, the cam follower pushes out the eccentric cam in a cassette attachment direction without engaging with the eccentric cam. Therefore, the eccentric cam of the conveyance unit described above is unable to press down the lift plate. In such a case, it has been required to rotate the eccentric cam once to engage with the cam follower to press down the lift plate. That is, the conveyance unit described above has a problem that it requires to consume a wasteful time and energy of returning the eccentric cam to the reference position.

SUMMARY

In accordance with an embodiment of the present disclosure, a conveyance unit includes a cassette and a conveyance interlocked part. The cassette removably is attached to an apparatus body. The conveyance interlocked part is provided in the apparatus body so as to be adjacent the cassette. The cassette includes a sheet storage part, a lift plate and a biasing member. The sheet storage part stores a sheet. The lift plate liftably is provided between a lowered position along a bottom plate of the sheet storage part and a raised position separated upward from the bottom plate. The biasing member biases the lift plate to the raised position so as to cause the sheet on the lift plate to contact with a pickup roller. The conveyance interlocked part includes a lever, a pressing mechanism and a support member. The lever engages with the lift plate when the cassette is attached to the apparatus body and being liftable together with the lift plate. The pressing mechanism presses the lever downward to keep the lift plate at the lowered position. The support member is provided between the apparatus body and the lever so as to suppress a drop of the lever disengaged from the lift plate when the cassette is detached from the apparatus body.

In accordance with an embodiment of the present disclosure, an image forming apparatus includes a conveyance unit delivering a sheet toward a conveyance path. The conveyance unit includes a cassette and a conveyance interlocked part. The cassette removably is attached to an apparatus body. The conveyance interlocked part is provided in the apparatus body so as to be adjacent the cassette. The cassette includes a sheet storage part, a lift plate and a biasing member. The sheet storage part stores a sheet. The lift plate liftably is provided between a lowered position along a bottom plate of the sheet storage part and a raised position separated upward from the bottom plate. The biasing member biases the lift plate to the raised position so as to cause the sheet on the lift plate to contact with a pickup roller. The conveyance interlocked part includes a lever, a pressing mechanism and a support member. The lever engages with the lift plate when the cassette is attached to the apparatus body and being liftable together with the lift plate. The pressing mechanism presses the lever downward to keep the lift plate at the lowered position. The support member is provided between the apparatus body and the lever so as to suppress a drop of the lever disengaged from the lift plate when the cassette is detached from the apparatus body.

The above and other objects, features, and advantages of the present disclosure will become more apparent from the following description when taken in conjunction with the accompanying drawings in which a preferred embodiment of the present disclosure is shown byway of illustrative example.

DETAILED DESCRIPTION

In the following, a preferable embodiment of the present disclosure will be described with reference to the appended drawings. It is noted that the following description will be made by setting a near side of each drawing as a front side and based on directions indicated in each drawing. Still further, such terms as 'upstream' and 'downstream' in the following description represent 'upstream', 'downstream' or the like in a conveying direction of a sheet S.

Figure 1:
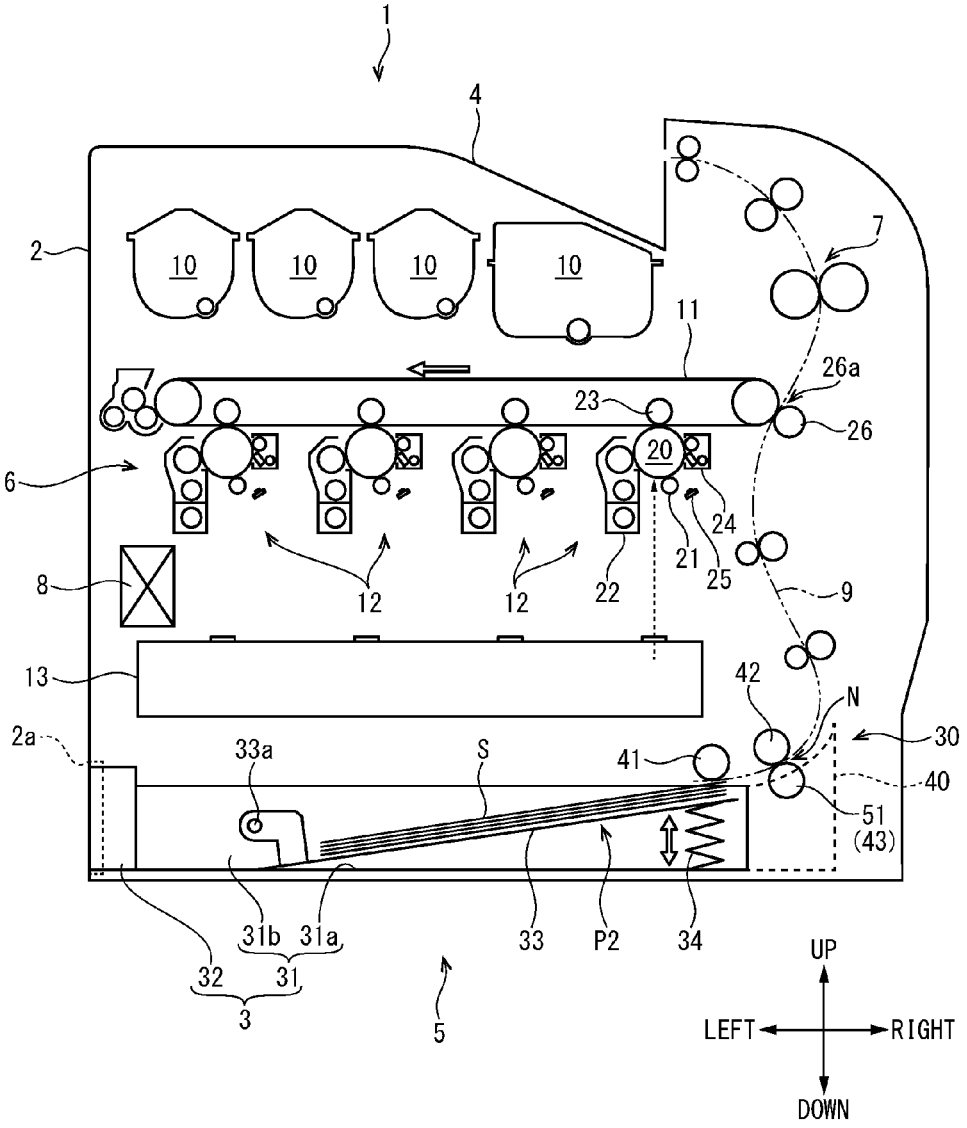
FIG. 1 is a sectional view schematically showing an inner structure of a color printer according to one embodiment of the present disclosure.

With reference to FIG. 1, an entire construction of a color printer 1 as an image forming apparatus will be described. FIG. 1 is a sectional view schematically showing an inner structure of the color printer 1.

The color printer 1 includes an apparatus body 2, a sheet feed cassette 3 and a sheet discharge tray 4. The apparatus body 2 is formed substantially into a shape of a box. The sheet feed cassette 3 as a cassette is provided drawably in a lower part of the apparatus body 2. The sheet discharge tray 4 is provided in a upper part of the apparatus body 2.

The color printer 1 also includes a conveyance unit 5, an image forming part 6, a fixing unit 7, and a control unit 8 within the apparatus body 2. The conveyance unit 5 is provided upstream of the sheet feed cassette 3 extended from the sheet feed cassette 3 to the sheet discharge tray 4. The image forming part 6 is provided at an intermediate part of the conveyance path 9. The fixing unit 7 is provided downstream of the conveyance path 9. The control unit 8 integrally controls the color printer 1.

As described in detail later, the conveyance unit 5 is provided to deliver a sheet S stored in the sheet feed cassette 3 described above toward the conveyance path 9.

The image forming part 6 includes four tonner containers 10, an intermediate transfer belt 11, four drum units 12 and an optical scanning device 13. The four toner containers 10 are arrayed in parallel in a left-right direction under the sheet discharge tray 4. The intermediate transfer belt 11 is disposed under the respective toner containers 10. The four drum units 12 are arrayed in parallel in the left-right direction under the intermediate transfer belt 11. The optical scanning unit 13 is disposed under the respective drum units 12.

The four tonner containers 20 house toners (developing agents) of four colors (yellow, magenta, cyan, black). It is noted that the toner may be a single-component developing agent made of a magnetic toner or may be a double-component developing agent including a toner and a carrier. The intermediate transfer belt 11 is driven so as to travel in a direction indicated by a white blanked arrow in FIG. 1.

The four drum units 12 are provided corresponding to the toners of the respective colors. Each of the drum units 12 includes a photosensitive drum 20, a charging device 21, a development device 22, a primary transferring roller 23, a cleaning device 24 and a static eliminator 25. Each drum unit 12 primarily transfers a toner image to the intermediate transfer belt 11. Disposed on a right side of the intermediate transfer belt 11 is a secondary transfer roller 26 forming a secondary transfer nip part 26*a*. The full-color toner image borne on the intermediate transfer belt 11 is secondarily transferred to a sheet S passing through the secondary transfer nip part 26*a*. The fixing unit 7 fixes the full-color toner image on the sheet S. The sheet S which has undergone the fixing process is then discharged out to the sheet discharge tray 4.

Figure 2:
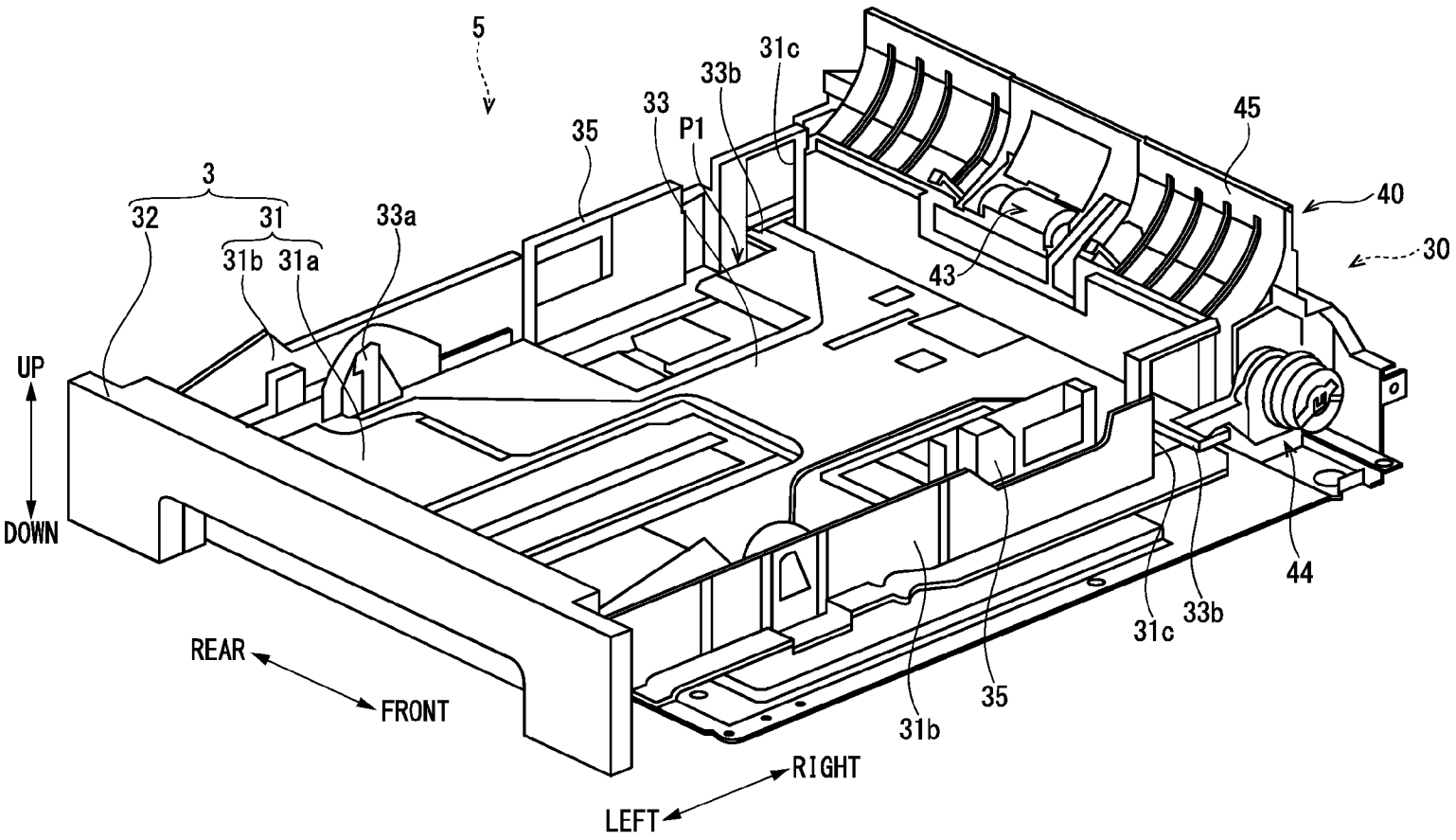
FIG. 2 is a perspective view illustrating a conveyance unit of one embodiment of the present disclosure.
Figure 3:
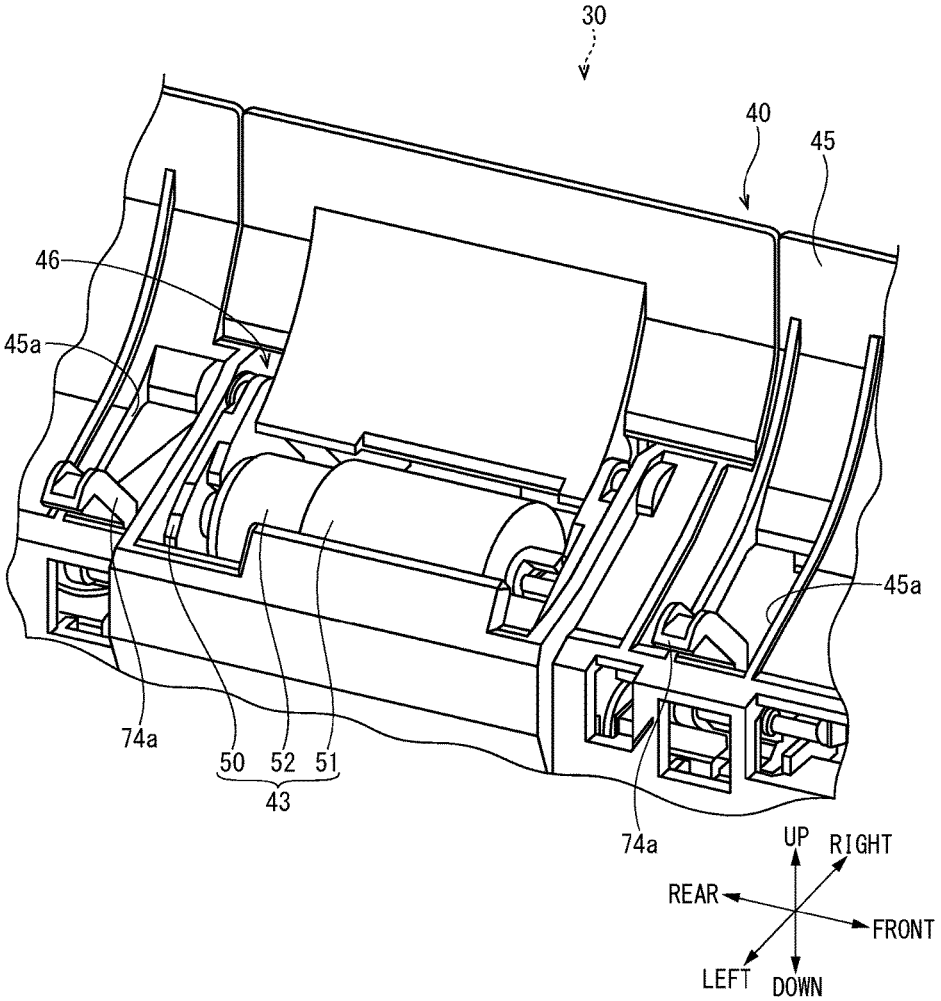
FIG. 3 is a perspective view illustrating a part of a conveying mechanism part of the conveyance unit of one embodiment of the present disclosure.
Figure 4:
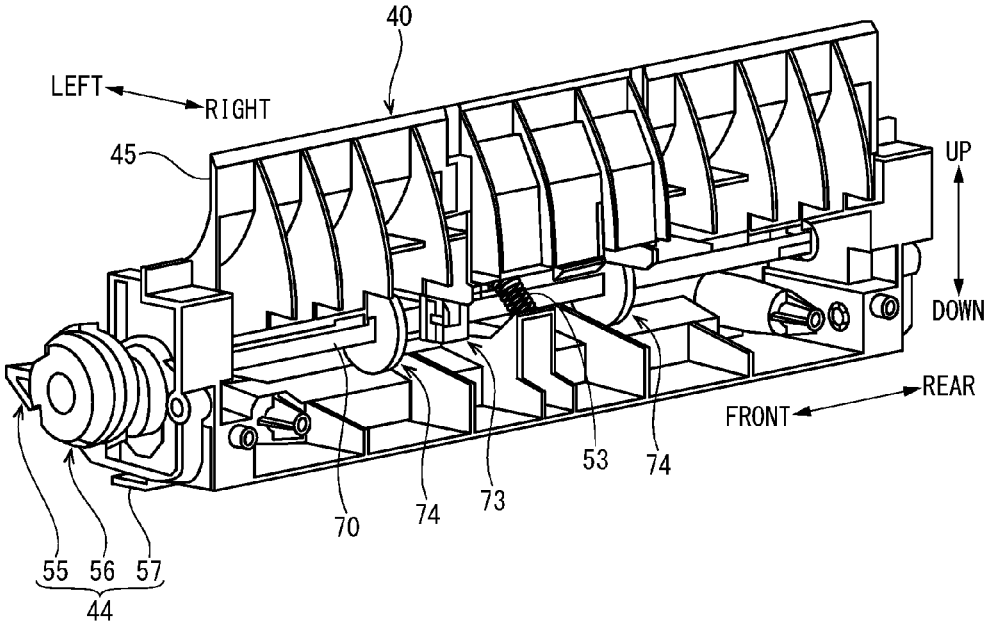
FIG. 4 is a perspective view illustrating a conveying mechanism part of the conveyance unit of one embodiment of the present disclosure.
Figure 5:
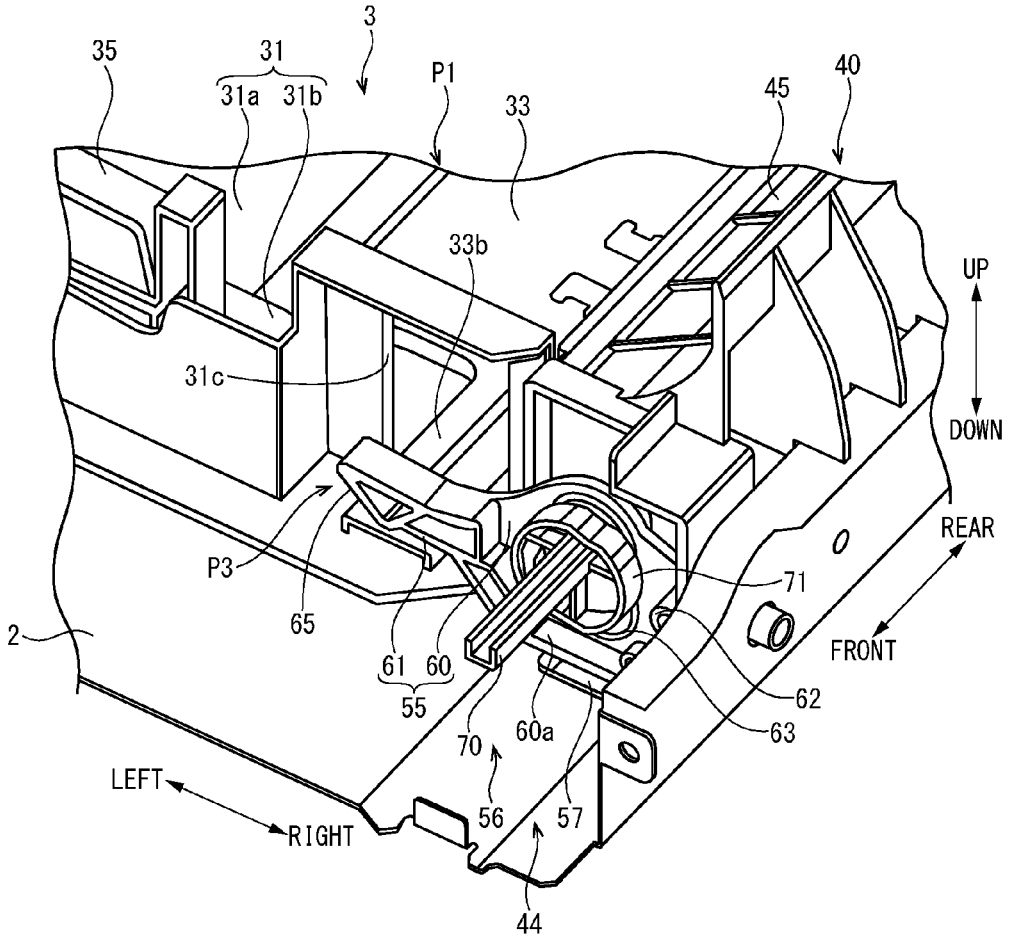
FIG. 5 is a perspective view illustrating a part of the sheet feed cassette and the conveyance interlocked part of the conveyance unit of one embodiment of the present disclosure.
Figure 6:
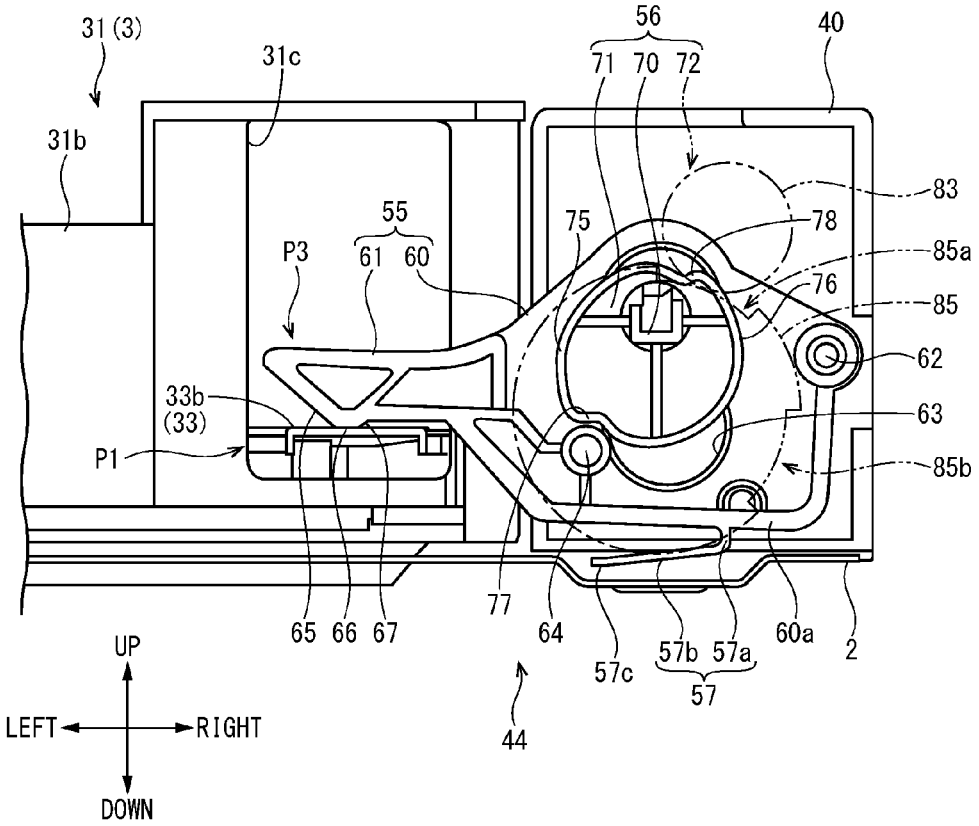
FIG. 6 is a side view illustrating a part of the sheet feed cassette and the conveyance interlocked part of the conveyance unit of one embodiment of the present disclosure.
Figure 7:
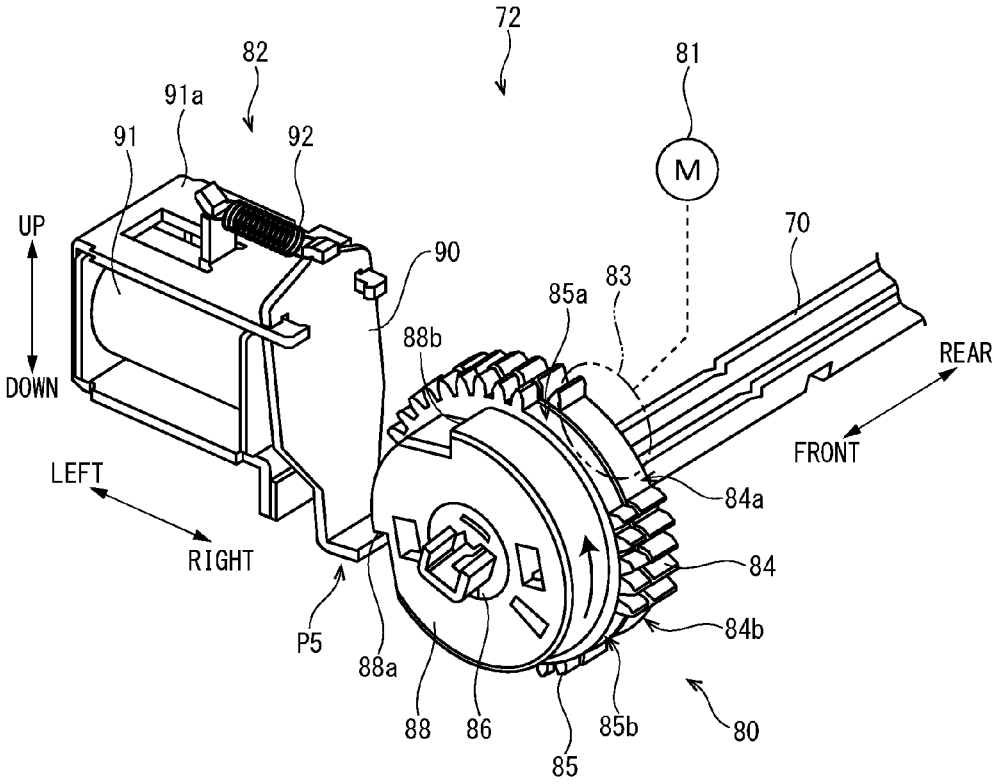
FIG. 7 is a perspective view illustrating a driving unit of the conveyance unit of one embodiment of the present disclosure.
Figure 8:
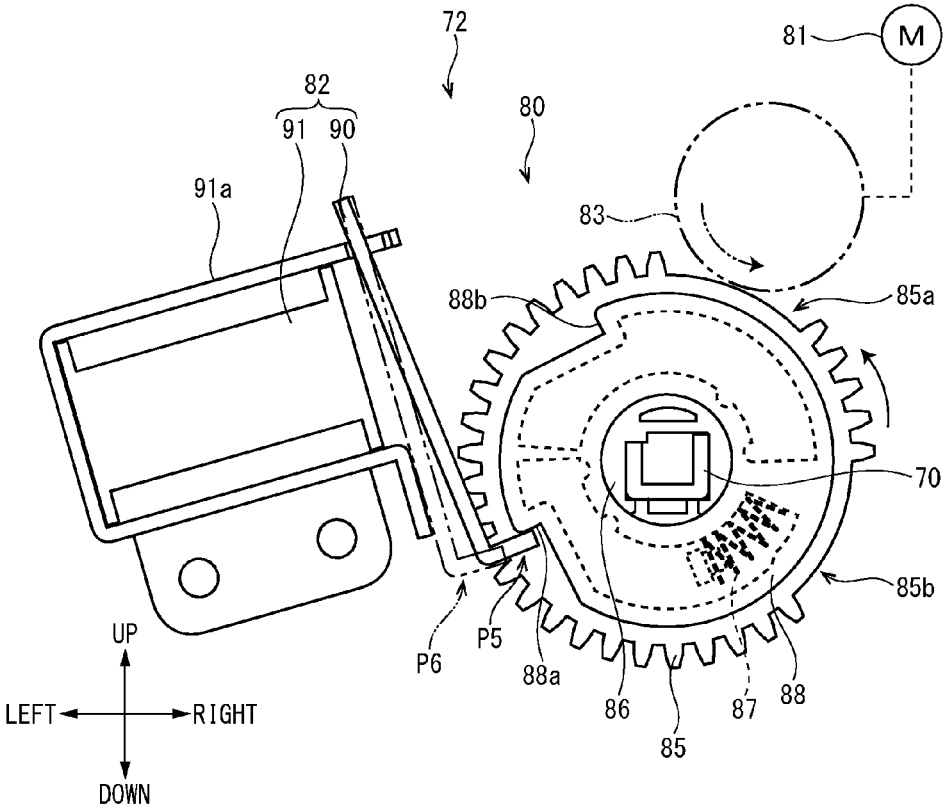
FIG. 8 is a side view illustrating a driving unit of the conveyance unit of one embodiment of the present disclosure.

Next, The conveyance unit 5 will be described in detail below with reference to FIGS. 1 through 8. FIG. 2 is a perspective view illustrating the conveyance unit 5. FIG. 3 is a perspective view illustrating a part of a conveying mechanism part 30. FIG. 4 is a perspective view illustrating a conveying mechanism part 30. FIG. 5 is a perspective view illustrating a part of the sheet feed cassette 3 and the conveyance interlocked part 44. FIG. 6 is a side view illustrating a part of the sheet feed cassette 3 and the conveyance interlocked part 44. FIG. 7 is a perspective view illustrating a driving unit 72. FIG. 8 is a side view illustrating a driving unit 72.

As shown in FIGS. 1 and 2, the conveyance unit 5 includes the sheet feed cassette 3 described above and the conveying mechanism part 30. The sheet feed cassette 3 stores the sheet S therein. The conveying mechanism part 30 is provided on the right side of the sheet feed cassette 3 attached to the apparatus body 2. The conveying mechanism part 30 delivers the sheet S within the sheet feed cassette 3 toward the conveyance path 9.

The sheet feed cassette 3 is configured to be insertable into the apparatus body 2 from an opening 2*a* provided at a lower left surface of the apparatus body 2. The sheet feed cassette 3 is also configured to be able to be drawn out of the opening part 2*a* in a left direction to replenish the sheet S.

The sheet feed cassette 3 includes a sheet storage part 31 and a designed surface part 32. The sheet storage part 31 is formed approximately into a shape of a rectangular box stacking and storing the sheet S. The designed surface part 32 is provided at a left end part of the sheet storage part 31. The designed surface part 32 composes a part of an exterior surface of the apparatus body 2 in the state in which the sheet feed cassette 3 is attached to the apparatus body 2.

The sheet feed cassette 3 includes within the sheet storage part 31, a lift plate 33, a push-up spring 34, and a pair of front and rear first cursors 35 and a second cursor (not shown).

The lift plate 33 is disposed on the right side of the bottom plate 31*a* (bottom part) of the sheet storage part 31. A pair of front and rear plate turning shafts 33*a* is provided at a left end part of the lift plate 33. The pair of front and rear plate turning shafts 33*a* is pivotably supported by a pair of front and rear side plates 31*b*. The lift plate 33 is supported turnably in a vertical direction centering the respective plate turning shafts 33*a*. More specifically, the lift plate 33 is provided liftably between a lowered position P1 (see FIG. 2) along the bottom part 31*a* of the sheet storage part 31 and a raised position P2 (see FIG. 1) separated upward from the bottom part 31*a*.

As shown in FIG. 2, a pair of pressure acting parts 33*b* is formed at both front and rear corners on the right side of the lift plate 33. The pair of pressure acting parts 33*b* extend toward outside from through holes 31*c* opened through the side plates 31*b* of the sheet storage part 31.

As shown in FIG. 1, the push-up spring 34, i.e., a biasing member, is provided between the right side of the lift plate 33 and the bottom plate 31*a*. The push-up spring 34 biases the lift plate 33 toward the raised position P2. The push-up spring 34 causes the sheet S stacked on the lift plate 33 to contact with a pickup roller 41.

As shown in FIG. 2, the pair of front and rear first cursors 35 is provided on the bottom plate 31*a* so as to face with each other while interposing the lift plate 33. The pair of front and rear first cursors 35 is connected respectively with an interlock mechanism (not shown) such as a lack and pinion. The pair of front and rear first cursors 35 slide symmetrically in the front and rear directions by the interlock mechanism and align a front-rear width of the sheet S (or bundle of sheets) stacked on the lift plate 33. It is noted that the second cursor is provided on the bottom plate 31*a* so as to slide in the right-left direction to align a left-right width of the sheet S (of bundle of sheets).

Next, the conveying mechanism part 30 is provided within the apparatus body 2 as shown in FIGS. 1 and 2. The conveying mechanism part 30 includes a guide part 40, the pickup roller 41, a sheet feed roller 42, a multiple-feed preventing part 43, and a conveyance interlocked part 44. The guide part 40 composes an upstream end part of the conveyance path 9. The pickup roller 41 is provided above the right end part of the lift plate 33. The sheet feed roller 42 is provided on the right side of the pickup roller 41. The multiple-feed preventing part 43 is provided under the sheet feed roller 42 so as to face the sheet feed roller 42. The conveyance interlocked part 44 is provided in the apparatus body 2 so as to be adjacent the right side of the sheet feed cassette 3.

As shown in FIGS. 2 through 4, the guide part 40 is formed approximately into a trapezoidal column lengthy in the front-rear direction. The guide part 40 is formed such that a front-rear width is approximately equal to that of the sheet feed cassette 3. The guide part 40 is provided with a guide surface 45 formed on an upper surface of the guide part 40 and guiding the sheet S conveyed by the sheet feed roller 42. The guide surface 45 composes a curved surface of rising gradient from upstream (left side) toward downstream (right side). A storage part 46 is concavely provided at a center part in the front-rear direction of the guide surface 45 (see FIG. 3).

As shown in FIG. 1, the pickup roller 41 and the sheet feed roller 42 are formed into a cylindrical shape and are pivotally supported by the apparatus body 2, respectively. The respective rollers 41 and 42 are rotationally driven by a driving unit (not shown). The pickup roller 41 delivers the sheet S on the lift plate 33 that has moved to the raised position P2 toward the guide surface 45. The sheet feed roller 42 conveys the sheet S further toward the downstream.

As shown in FIG. 3, the multiple-feed preventing part 43 includes a holder 50, a retard roller 51, and a torque limiter 52. The multiple-feed preventing part 43 is configured to prevent the sheet S conveyed by the sheet feed roller 42 from being multiply fed.

The holder 50 is supported swingably within the storage part 46. The holder 50 is biased upward by a coil spring 53 installed between the holder 50 and the guide part 40 (see FIG. 4). The retard roller 51 is formed into a cylindrical shape and is supported rotatably on a circumferential surface of the torque limiter 52. The torque limiter 52 is supported unrotatably by the holder 50. The torque limiter 52 is configured to be able to rotate more than a torque set in advance in order to control the rotation of the retard roller 51.

Still further, the retard roller 51 is in pressure contact with the sheet feed roller 42 by being biased by the coil spring 53 and composes a conveying nip N with the sheet feed roller 42 (see FIG. 1). The retard roller 51 separates an overlapped sheets S by an operation of the torque limiter 52.

As shown in FIGS. 4 and 5, the conveyance interlocked part 44 includes a pair of front and rear levers 55, a pressing mechanism 56, and a pair of front and rear supporting members 57. Each lever 55 is configured so as to engage with the lift plate 33 of the sheet feed cassette 3 attached to the apparatus body 2 as described in detail later and so as to be liftable together with the lift plate 33. The pressing mechanism 56 is configured to press each lever 55 downward to keep the lift plate 33 at the lowered position P1. Each support member 57 is provided between the apparatus body 2 and the lever 55.

As shown in FIGS. 5 and 6, each of the pair of front and rear levers 55 includes a lever body 60 and an arm part 61. Each lever 55 is formed in a body by a synthetic resin material for example. It is noted that because the pair of front and rear levers 55 is formed symmetrically with each other, the following description will be made noticing on the front lever 55.

The lever body 60 is formed approximately into a pentagonal plate in a front view. A flange part 60*a* extending in the front side is formed at a lower end part of the lever body 60. A lever turning shaft 62 is provided on a right end of the lever body 60. The lever turning shaft 62 is pivotally supported by a front end surface of the guide part 40. Accordingly, the lever body 60 is provided so as to operate inter-connectedly with the lift of the lift plate 33 and so as to be able to turn in the vertical direction around the lever turning shaft 62.

The lever body 60 is provided with a curved hole 63 formed so as to penetrate in the front-rear direction. The curved hole 63 extends in the vertical direction at a center part in the left-right direction of the lever body 60. The curved hole 63 is curved so as to follow a locus of the turn of the lever body 60. Provided projectively toward the front side at an edge part of a lower left side of the curved hole 63 is a columnar boss 64. The boss 64 is provided in the lever body 60 so as to be relatively slidably along cam surfaces 75 and 76 of an eccentric cam 71 described later.

The arm part 61 extends from a front end part of the lever body 60 toward the lift plate 33 side (left side). The arm part 61 is formed approximately into a quadrangular pillar having an equal width with the flange part 60*a*. A front end part (left end part) of the arm part 61 contacts with an upper surface of the pressure acting part 33*b* of the lift plate 33. The front end part of the arm part 61 is formed approximately in to a triangular column in a front view. More specifically, the arm part 61 is provided with an inclined surface 65 of down gradient from the front end side (left side) to a base end side (right side) formed at a lower side of the front end part thereof.

As shown in FIG. 6, an abutment surface 66 is formed at a lowermost end of the inclined surface 65, and an engagement surface 67 is formed on the base end side (right side) of the abutment surface 66. The abutment surface 66 is formed to be approximately in parallel (horizontal) with an upper surface of the arm part 61 such that the arm part 61 contacts with the lift plate 33 (the pressure acting part 33*b*) located at the lowered position P1. The engagement surface 67 is formed such that a front end part (right end part) of the lift plate 33 located at the raised position P2 engages with the engagement surface 67 (see FIG. 10).

It is noted that in the following description, a position of the lever 55 where the arm part 61 contacts with the lift plate 33 located at the lowered position P1 will be called as a pressing position P3 (see FIG. 6). Meanwhile, a position of the lever 55 where the arm part 61 contacts with the lift plate 33 located at the raised position P2 will be called as a non-pressing position P4 (see FIG. 10).

As shown in FIGS. 5 and 6, the pressing mechanism 56 includes a shaft 70 (eccentric shaft), a pair of front and rear eccentric cams 71, and a driving unit 72.

The shaft 70 is formed into a shape of a rod having approximately a shape of U in section by a metallic material such as iron. The shaft 70 penetrates through the guide part 40 in the front-rear direction and is supported rotatably by the guide part 40 (see FIG. 4). Both front and rear end parts of the shaft 70 penetrate through the curved hole 63 of the pair of front and rear levers 55 (the lever body 60).

As shown in FIG. 4, the shaft 70 is configured so as to engage with a nip releasing mechanism 73 and a pair of sheet returning mechanisms 74 provided in the guide part 40. The nip releasing mechanism 73 is provided on the front side of the multiple-feed preventing part 43. The nip releasing mechanism 73 is configured so as to turn the multiple-feed preventing part 43 downward by operating inter-connectedly with the rotation of the shaft 70. This arrangement makes it possible to release the conveying nip N. The pair of front and back sheet returning mechanisms 74 is provided both front and rear sides of the multiple-feed preventing part 43 (the storage part 46). Each sheet returning mechanism 74 includes a hook 74*a* capable of projecting out of a slot 45*a* opened through the guide surface 45 (see FIG. 3). Each sheet returning mechanism causes the hook 74*a* to jump out of the slot 45*a* inter-connectedly with the rotation of the shaft 70. This arrangement makes it possible to push back the sheet S left on the guide surface 45 to the upstream side.

As shown in FIG. 6, the pair of eccentric cams 71 is fixed at both front and rear end parts of the shaft 70. Each eccentric cam 71 is a so-called disk cam, and is configured such that a distance from a center of rotation of the shaft 70 to its circumference (referred to as an "eccentric radius" hereinafter) is not fixed. It is noted that because the pair of front and rear eccentric cams 71 is formed symmetrically, the following description will be made by noticing on the front eccentric cam 71.

The first and second cam surfaces 75 and 76 are continuously formed on an outer circumferential surface of the eccentric cam 71. The first cam surface 75 has the eccentric radius that permits the eccentric cam 71 to come into slidable contact with the boss 64 of the lever body 60 and the lever 55 to turn upward. The second cam surface 76 has the eccentric radius that permits the eccentric cam 71 to come into slidable contact with the boss 64 of the lever body 60 and the lever 55 to turn downward by pressing the boss 64.

The first and second cam surfaces 75 and 76 are continuously formed on the side where the eccentric radius is large through a lock part 77. The lock part 77 is concaved from the first cam surface 75 toward the second cam surface 76. Still further, the first and second cam surfaces 75 and 76 are continuously formed on a side where the eccentric radius is small through a stepped part 78. The stepped part 78 is concaved from the second cam surface 76 toward the first cam surface 75. The stepped part 78 is formed such that a difference of step thereof is smaller than that of the lock part 77.

As shown in FIGS. 7 and 8, the driving unit 72 includes a transmission mechanism 80, a driving motor 81, and a restricting unit 82. The transmission mechanism 80 is connected with a front end part of the shaft 70. The driving motor 81, i.e., a driving source, rotationally drives the transmission mechanism 80. The restricting unit 82 restricts the rotation of the transmission mechanism 80. The driving unit 72 is configured to rotate each eccentric cam 71 (the shaft 70) in one direction.

As shown in FIG. 7, the transmission mechanism 80 includes an input gear 83, a first gear 84, and a second gear 85. The respective gears 83 through 85 transmit a rotational driving force of the driving motor 81 to the eccentric cam 71.

The input gear 83 is a so-called spur gear and is rotationally driven by the driving motor 81. The first gear 84 is a spur gear having two tooth lacking parts 84*a* and 84*b* (parts lacking tooth). The first gear 84 is fixed to the front end part of the shaft 70. The first gear 84 rotates in a body with the eccentric cam 71.

The second gear 85 is also a spur gear having two tooth lacking parts 85*a* and 85*b* as shown in FIGS. 7 and 8. The second gear 85 is rotatably attached to the front end part of the shaft 70 through a cylindrical shaft part 86. The second gear 85 is disposed so as to be in contact with a front side of the first gear 84. The second gear 85 is connected with the first gear 84 through a compression spring 87 provided between the first gear 84 and the second gear 85. A columnar part 88 around which no tooth is formed is projectively provided at a front end surface of the second gear 85. Provided on a circumferential surface of the columnar part 88 are two receded parts 88*a* and 88*b* separated from each other in a circumferential direction.

The restricting unit 82 includes a hook member 90 and a solenoid mechanism 91.

The hook member 90 is formed of a metallic plate such as iron approximately into a shape of a letter L in a front view. The hook member 90 is turnably supported by an upper part of a frame 91*a* of the solenoid mechanism 91. A tensile spring 92 is provided between an upper end of the hook member 90 and an upper surface of the frame 91*a*. The hook member 90 is pulled by the tensile spring 92 such that a lower end part thereof projects toward the second gear 85. Thereby, the lower end part of the hook member 90 engages with either one of the two receded parts 88*a* and 88*b*. It is noted that in the following description, a position where the hook member 90 engages with the recessed parts 88*a* and 88*b* will be called as an engage position P5.

The solenoid mechanism 91 is disposed on a side opposite the second gear 85 while interposing the hook member 90. By receiving power supply, the solenoid mechanism 91 attracts the hook member 90 while resisting against a bias force of the tensile spring 92. Thereby, the lower end part of the hook member 90 is detached from the recessed parts 88*a* and 88*b*. It is noted that in the following description, a position where the hook member 90 is detached from the recessed parts 88*a* and 88*b* will be called as a releasing position P6.

It is noted that the driving motor 81, the restricting unit 82, and others are connected with a power source (not shown) to receive the electric power supply. The control unit 8 controls the power source and others to control the drives of the driving motor 81, the restricting unit 82, and others.

As shown in FIG. 6, the pair of front and rear supporting members 57 are integrally formed with the lever 55 by a synthetic resin material for example. It is noted that because the pair of front and rear supporting members 57 is formed symmetrically, the following description will be made by noticing on the front side supporting member 57. It is noted that the following description will be made based on the lever 55 located at the pressing position P3.

The support member 57 extends from a lower surface of the lever body 60 so as to bend to the lift plate 33 side (left side) and is formed approximately into a shape of letter L. More specifically, the support member 57 includes a base part 57*a* and an extension part 57*b*. The base part 57*a* slightly extends downward from the lower surface of the lever body 60. The extension part 57*b* extends in the left direction from a lower part of the base part 57*a*. The extension part 57*b* inclines toward the left side from the base part 57*a* side so as to be distant from the lower surface of the lever body 60. Formed at a free end (left end part) of the extension part 57*b* is an abutment part 57*c* approximately in parallel with the lower surface of the lever body 60.

The support member 57 is formed to be elastically deformable in the lift direction of the lever 55 (vertical direction). More specifically, the extension part 57*b* elastically deforms so as to turn in the vertical direction centering on a part connected with the base part 57*a*.

Figure 9:
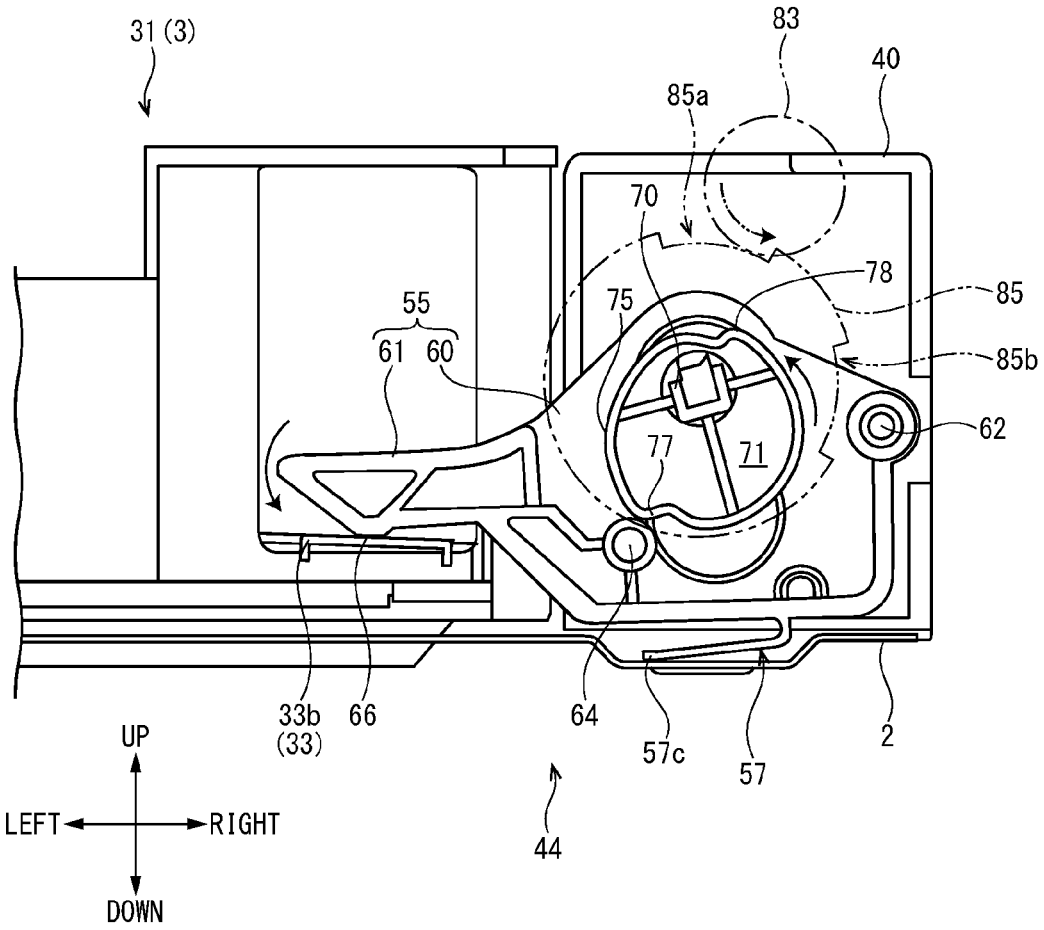
FIG. 9 is a side view illustrating a part of the sheet feed cassette and the conveyance interlocked part of the conveyance unit of one embodiment of the present disclosure in a state in which a lever is lowered further from a pressing position.
Figure 10:
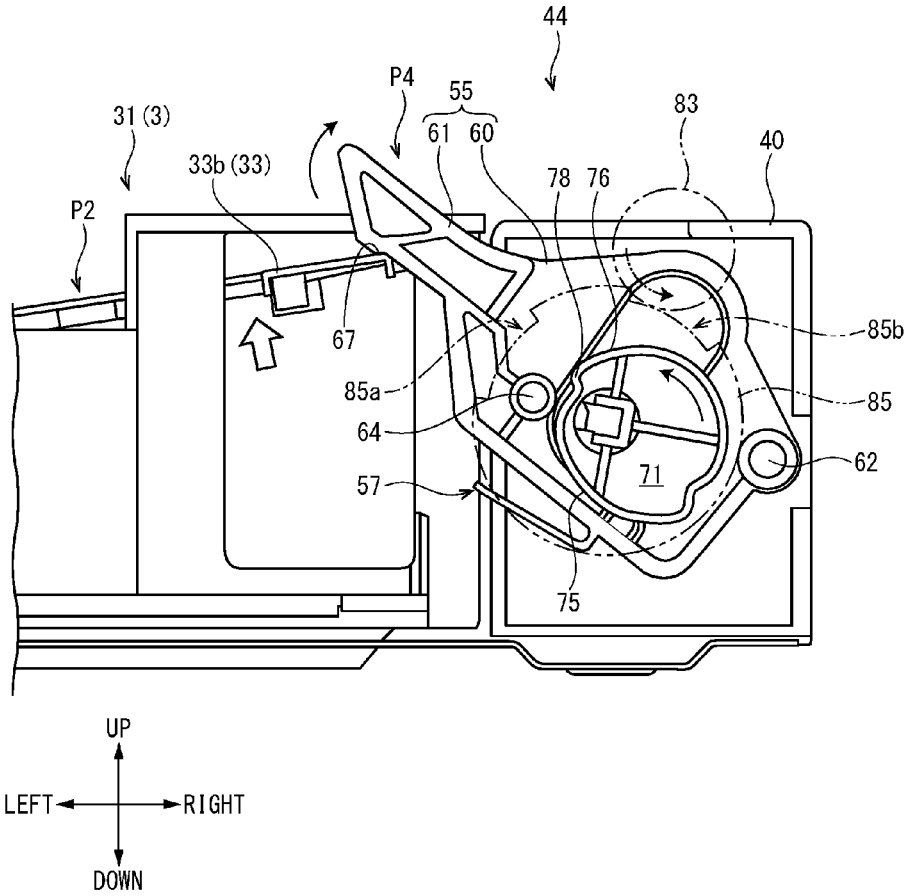
FIG. 10 is a side view illustrating a part of the sheet feed cassette and the conveyance interlocked part of the conveyance unit of one embodiment in a state in which the lever is lifted to a non-pressed position.

Next, operations of the conveyance unit 5 will be described with reference to FIGS. 6, 8 through 10. FIG. 9 is a side view illustrating a part of the conveyance interlocked part 44 or the like in a state in which a lever 55 is lowered further from a pressing position P3. FIG. 10 is a side view illustrating a part of the conveyance interlocked part 44 or the like in a state in which the lever 55 is lifted to a non-pressed position P4. It is noted that the following description will be made by assuming a state in which the sheet feed cassette 3 is attached into the apparatus body 2. It is noted that the description will be made by continuously noticing on the front lever 55, the support member 57, and the eccentric cam 71.

When no sheet S is supplied (fed), the eccentric cam 71 is located at a position where the boss 64 of the lever 55 fits into the lock part 77 (referred to as a 'reference position' hereinafter) and the lever 55 is kept at the pressing position P3 as shown in FIG. 6. The lever 55 displaced to the pressing position P3 by the eccentric cam 71 presses the lift plate 33 from above by resisting against a bias force of the push-up spring 34. Thereby, the lift plate 33 is kept at the lowered position P1. It is noted that the boss 64 of the lever 55 is kept in the state of fitting with the lock part 77 of the eccentric cam 71 by receiving the bias force of the push-up spring 34 through the lift plate 33.

In the state described above, the input gear 83 faces the tooth lacking part 85*a* downstream in a rotation direction of the second gear 85. The compression spring 87 is compressed between the first and second gears 84 and 85. The hook member 90 of the restricting unit 82 is moved to the engaging position P5 and is engaged with the recessed part 88*a* downstream in the rotation direction of the second gear 85 (see a solid line in FIG. 8). That is, the rotation of the second gear 85 (the transmission mechanism 80) is restricted. The support member 57 is located at a position not in contact with the bottom surface of the apparatus body 2.

Next, in a case of supplying (feeding) the sheet S, the control unit 8 drives and controls the solenoid mechanism 91 of the restricting unit 82 to move the hook member 90 to the releasing position P6 (see a two-dot chain line in FIG. 8). The control unit 8 also drives and controls the driving motor 81 to rotate the input gear 83. In response to the move of the hook member 90 to the releasing position P6, only the second gear 85 rotates counterclockwise by a restoration force (bias force) of the compression spring 87 being compressed as shown in FIG. 6 and others. The second gear 85 rotated by the compression spring 87 engages with the input gear 83 rotationally driven (see FIG. 9). The second gear 85 that has engaged with the input gear 83 rotates while compressing the compression spring 87. In response to an advance of the rotation of the second gear 85, the first gear 84 is integrated with the second gear 85 through the compression spring 87 and starts to rotate. Thereby, the shaft 70 and the eccentric cam 71 also start to rotate counterclockwise as shown in FIG. 9 and others.

In response to the advance of the rotation of the eccentric cam 71, relatively the boss 64 of the lever 55 rides over the lock part 77 and moves toward the first cam surface 75 as shown in FIG. 9. At this time, the part where the lock part 77 is connected with the first cam surface 75 pushes the boss 64 of the lever 55 downward. Accordingly, the lever 55 turns downward, and the abutment part 57*c* of the support member 57 contacts with the bottom surface of the apparatus body 2. The lever 55 turns downward while elastically deforming the support member 57 (the extension part 57*b*). It is noted that at this time, the lever 55 pushes down the lift plate 33 further from the lowered position P1 by resisting against the bias force of the push-up spring 34.

As described above, each support member 57 elastically deforms by causing the L-shaped free end (the support member 57) to contact with the bottom surface of the apparatus body 2. Because the free end part of each support member 57 extends to the lift plate 33 side (left side), each support member 57 can smoothly deflect while assuring an adequate displacement.

When the boss 64 is disengaged from the lock part 77 and starts to be in slidable contact with the first cam surface 75, the lever 55 turns upward by a restoration force of the support member 57 and the bias force of the push-up spring 34. It is noted that the lift plate 33 also returns to the lowered position P1 by the bias force of the push-up spring 34.

As described above, the first cam surface 75 has the eccentric radius that permits the lever 55 to rise. Therefore, in response to the further advance of the rotation of the eccentric cam 71, the lift plate 33 rises from the lowered position P1 toward the raised position P2 by being biased by the push-up spring 34. The lever 55 rises from the pressing position P3 toward the non-pressing position P4 in linkage with the rise of the lift plate 33. Still further, the boss 64 of the lever 55 relatively moves to a position just before the stepped part 78 along the first cam surface 75.

When the boss 64 moves to the position just before the stepped part 78, the control unit 8 controls the solenoid mechanism 91 of the restricting unit 82 to move the hook member 90 to the engaging position P5. Thereby, the hook member 90 engages with the recessed part 88*b* upstream in the rotation direction of the second gear 85 (not shown). In this state, the second gear 85 rotates to the position where the tooth lacking part 85*b* upstream in the rotation direction faces the input gear 83. Accordingly, the driving force to be inputted from the input gear 83 to the second gear 85 is interrupted. It is noted that at this time, the control unit 8 may control the driving motor 81 to stop driving.

It is noted that during the process in which the lever 55 turns from the pressing position P3 to the non-pressing position P4, a rotation of the shaft 70 is transmitted to the nip releasing mechanism 73 (see FIG. 4). The nip releasing mechanism 73 turns the multiple feed preventing part 43 upward and brings the retard roller 51 into pressure contact with the sheet feed roller 42. Thereby, the conveying nip N is formed. It is noted in the case of supplying the sheet S, each return hock 74*a* faces under the guide surface 45.

By being pushed up to the raised position P2, the lift plate 33 presses the sheet S (of a bundle) stacked thereon against the pickup roller 41 (see FIG. 1). The pickup roller 41 comes into contact with the uppermost sheet S and delivers the sheet S toward the conveying nip N.

Here, in a case when one sheet S is sent to the conveying nip N, the retard roller 51 receives a large torque (a torque exceeding a restrictable range of the torque limiter 52) from the sheet feed roller 42 while interposing the sheet S and is driven. Thereby, the sheet S is conveyed along the guide surface 45 and is sent to the conveying path 9. Meanwhile, in a case when two sheets S are sent to the conveying nip N, the torque transmitted from the sheet feed roller 42 to the retard roller 51 is weakened. Due to that, the torque limiter 52 becomes operative, and the retard roller 51 does not rotate. As a result, the retard roller 51 gives a frictional force to a sheet S other than the sheet Sin direct contact with the sheet feed roller 42. Thereby, the sheet feed roller 42 sends only the sheet S in direction contact with the sheet feed roller 42 to the conveying path 9.

After finishing supplying the sheet S, the control unit 8 makes a control of returning the eccentric cam 71 to the reference position. At first, the control unit 8 drives and controls the solenoid mechanism 91 to move the hook member 90 to the releasing position P6 and drives and controls the driving motor 81 to rotate the input gear 83. In response to the move of the hook member 90 to the releasing position P6, only the second gear 85 rotates counterclockwise and engages with the input gear 83 as shown in FIG. 10 and others by the restoration force of the compression spring 87 being compressed. The second gear 85 that has engaged with the input gear 83 rotates while compressing the compression spring 87. Soon after that, the first gear 84 is integrated with the second gear 85 through the compression spring 87 and starts to rotate. Thereby, the shaft and the eccentric cam 71 also start to rotate counterclockwise as shown in FIG. 10 and others.

The rotation of the shaft 70 is transmitted to the nip releasing mechanism 73 (see FIG. 4). The nip releasing mechanism 73 turns the multiple feed preventing part 43 downward and releases the conveying nip N.

In response to the advance of the rotation of the eccentric cam 71, the boss 64 of the lever 55 comes relatively into contact with the stepped part 78 and moves toward the second cam surface 76. Because the second cam surface 76 has the eccentric radius that pushes down the boss 64, the lever 55 turns downward and presses the lift plate 33 down by resisting against the bias force of the push-up spring 34. Thereby, the sheet S on the lift plate 33 is separated downward from the pickup roller 41.

It is noted in the process in which the lever 55 is lowered, the rotation of the shaft 70 is transmitted to each returning mechanism 74. Thereby, each returning hook 74*a* jumps out of the slot 45*a* of the guide surface 45 in linkage with the drop of the lever 55 and returns the sheet S on the guide surface 45 to the sheet storage part 31 side (on the lift plate 33).

In response to the further advance of the rotation of the eccentric cam 71, the lever 55 moves from the non-pressing position P4 to the pressing position P3 and the lift plate 33 moves from the raised position P2 to the lowered position P1 as shown in FIG. 6. In this state, the boss 64 of the lever 55 is locked by the lock part 77 of the eccentric cam 71. That is, the eccentric cam 71 returns to the reference position and keeps the lever 55 at the pressing position P3 (the lift plate 33 is kept at the lowered position P1). It is noted that when the eccentric cam 71 moves to the reference position, the control unit 8 controls the solenoid mechanism 91 to move the hook member 90 to the engaging position P5 and controls the driving motor 81 to stop driving.

As described above, when the eccentric cam 71 rotates and the boss 64 is locked by the lock part 77, the lever 55 keeps the lift plate 33 at the lowered position P1. Meanwhile, when the eccentric cam 71 rotates and the boss 64 is unlocked from the lock part 77, the lever 55 is lowered within the range in which the support member 57 is elastically deformable and becomes liftable together with the lift plate 33.

According to the conveyance unit 5 of the present embodiment described above, when the eccentric cam 71 rotates from the condition in which the boss 64 is locked by the lock part 77, the lock part 77 rides over the boss 64 and the lever 55 is slightly lowered. At this time, the support member 57 permits the eccentric cam 71 to rotate while suppressing a postural change of the lever 55 by the elastic deformation. This arrangement makes it possible to link the lift of the lift plate 33 with the rotation of the eccentric cam 71.

Still further, according to the conveyance unit 5 of the present embodiment, the transmission mechanism 80 and the restricting unit 82 control the rotation of the eccentric cam 71 through the respective gears 84 and 85 by cooperating with each other. This arrangement makes it possible to control the rotation of the eccentric cam 71 corresponding to a status of conveyance of the sheet S.

Figure 11:
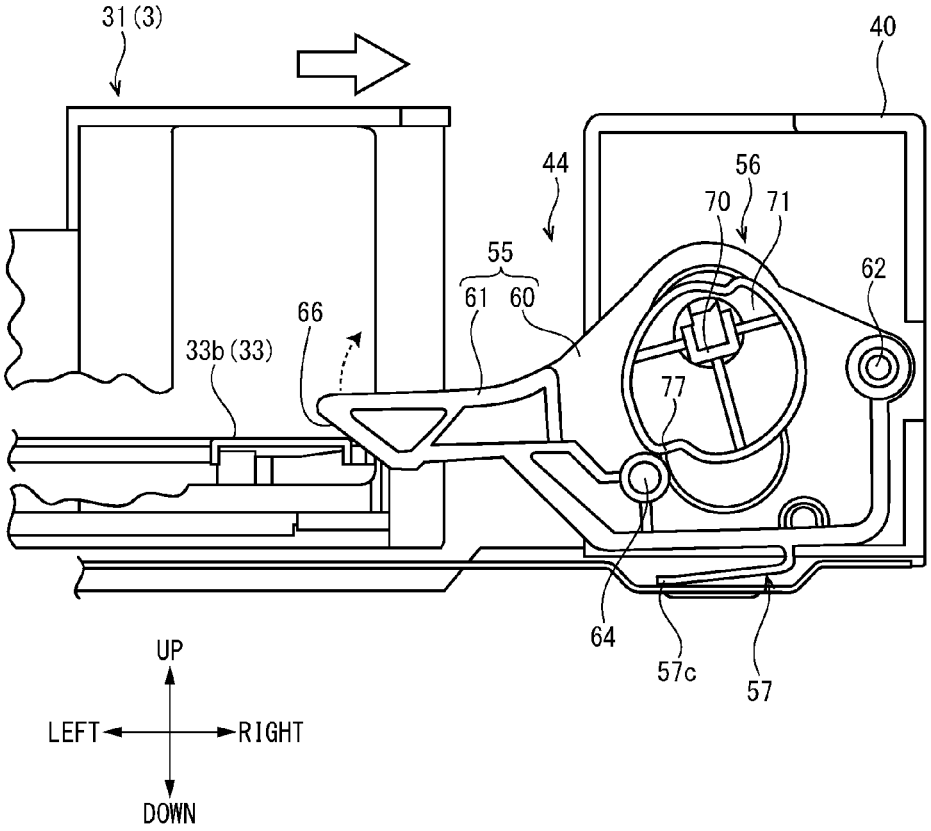
FIG. 11 is a side view illustrating a part of the conveyance interlocked part of the conveyance unit of one embodiment in attaching the sheet feed cassette.

Next, an operation of the conveyance interlocked part 44 in the case when the sheet feed cassette 3 is drawn out of the apparatus body 2 will be described with reference to FIG. 11. FIG. 11 is a side view illustrating a part of the conveyance interlocked part 44 when the sheet feed cassette 3 is to be attached.

By the way, when there is no sheet S or there is only few sheets S on the lift plate 33, the lift plate 33 is biased by the push-up spring 34 and is displaced to the raised position P2 (see FIG. 10). The sheet feed cassette 3 is drawn out of the apparatus body 2 (the opening part 2*a*) in this state to replenish sheets S. When the sheet feed cassette 3 is detached from the apparatus body 2, while each lever 55 turns downward, its turn is restricted because each support member 57 comes into contact with the bottom surface of the apparatus body 2 (see FIG. 11).

Meanwhile, in a case when the sheets S are fully stacked or a large number of sheets are stacked on the lift plate 33, the lift plate 33 is displaced to the lowered position P1 by weight of the sheets S. The sheet feed cassette 3 may be able to be drawn out of the apparatus body 2 (the opening part 2*a*) also in this state. The lift plate 33 is pressed downward by the pressing mechanism 56 (the eccentric cam 71) through each lever 55 as described above. When the sheet feed cassette 3 is detached out of the apparatus body 2 in this state, each lever 55 separates relatively from the lift plate 33 and is pressed downward by the pressing mechanism 56. At this time, although each lever 55 tries to turn downward, each support member 57 suppresses each lever 55 from being lowered (see FIG. 11). That is, each support member 57 keeps the posture of each lever 55 approximately to the same posture of the lever 55 before the sheet feed cassette 3 has been detached.

Here, the sheet feed cassette 3 is provided with a lock mechanism not shown to lock the lift plate 33 at the lowered position P1 when the sheet feed cassette 3 is drawn out. When the sheet feed cassette 3 is attached to the apparatus body 2, the lift plate 33 is kept (locked) at the lowered position P1 by the operation of the lock mechanism. The lock mechanism is configured to release the lock of the lift plate 33 in the process of attaching the sheet feed cassette 3 into the apparatus body 2 (just before completing the attachment).

Although not shown, if there is no support member 57, each lever 55 turns downward and the arm part 61 inclines in a lower left direction. If the sheet feed cassette 3 is caused to enter within the apparatus body 2 in this state, there is a possibility that the pressure acting part 33*b* of the lift plate 33 collides against the arm part 61 of the lever 55. In such a case, there is a possibility that not only the cassette 3 cannot be smoothly attached into the apparatus body 2, but also of breaking the lift plate 33, the lever 55 and others.

In this regard, according to the conveyance unit 5 of the present embodiment, each support member 57 operates so as to suppress the drop of each lever 55 disengaged from the lift plate 33 when the sheet feed cassette 3 is detached from the apparatus body 2. That is, regardless whether or not there is the sheet feed cassette 3, the posture of each lever 55 is kept approximately constant. Du to that, each lever 55 will not become an obstacle in moving the lift plate 33 (the pressure acting part 33*b*) in the process of attaching the sheet feed cassette 3 into the apparatus body 2. This arrangement makes it possible to smoothly attach the sheet feed cassette 3 into the apparatus body 2 such that each lever 55 engages adequately with the lift plate 33 (the pressure acting part 33*b*).

Still further, according to the conveyance unit 5 of the present embodiment, the inclined surface 65 is formed at the lower side of the tip part of the arm part 61. Accordingly, each pressure acting part 33*b* of the lift plate 33 is guided by the inclined surface 65 and enters under the arm part 61 (see FIG. 11) in the process of attaching the sheet feed cassette 3 into the apparatus body 2. This arrangement also makes it possible to smoothly attach the sheet feed cassette 3 into the apparatus body 2.

It is noted that while each support member 57 of the conveyance unit 5 of the present embodiment is formed integrally with each lever 55, the present disclosure is not limited to such configuration. For instance, each support member 57 may be provided on the bottom surface of the apparatus body 2 or on the side surface of the guide part 40. That is, each support member 57 is just required to be provided between the each lever member 55 and the apparatus body 2. Still further, although each support member 57 is formed of the synthetic resin material, the material is not limited to be resin and the support member may be formed of an elastic member such as a spring and rubber.

Still further, although the pairs of front and rear levers 55 (the support member 57), the eccentric cams 71 and others have been provided in the conveyance unit 5 of the present embodiment, the present disclosure is not limited to such configuration. For instance, the lever 55 (the support member 57), the eccentric cam 71, and others are just required to be provided at least at either one of the front and rear sides.

While the preferable embodiment and its modified example of the conveyance unit and the image forming apparatus of the present disclosure have been described above and various technically preferable configurations have been illustrated, a technical range of the disclosure is not to be restricted by the description and illustration of the embodiment. Further, the components in the embodiment of the disclosure may be suitably replaced with other components, or variously combined with the other components. The claims are not restricted by the description of the embodiment of the disclosure as mentioned above.

What is claimed is:

1. A conveyance unit comprising:

a cassette removably attached to an apparatus body;

a conveyance interlocked part provided in the apparatus body so as to be adjacent the cassette;

wherein the cassette includes;

a sheet storage part configured to store a sheet;

a lift plate liftably provided between a lowered position along a bottom plate of the sheet storage part and a raised position separated upward from the bottom plate; and a biasing member configured to bias the lift plate to the raised position so as to cause the sheet on the lift plate to contact with a pickup roller;

wherein the conveyance interlocked part includes:

a lever configured to engage with the lift plate when the cassette is attached to the apparatus body and being liftable together with the lift plate;

a pressing mechanism configured to press the lever downward to keep the lift plate at the lowered position; and a support member provided between the apparatus body and the lever so as to suppress a drop of the lever disengaged from the lift plate when the cassette is detached from the apparatus body, wherein the pressing mechanism includes:

an eccentric cam fixed to an eccentric shaft; and a driving unit configured to rotate the eccentric cam in one direction;

wherein the eccentric cam includes a lock part receded on a surface of the eccentric cam, the lever includes:

a lever body rotatably attached to the apparatus body around a lever turning shaft;

an arm part configured to extend from the lever body toward the lift plate and coming into contact with an upper surface of the lift plate; and a boss provided in the lever body so as to be relatively slidably along the surface;

the support member is formed to be elastically deformable in the lift direction of the lever, the lever is disposed at a pressing position and holds the lift plate in the lowered position when the eccentric cam rotates and the boss is locked by the lock part, and the lever is lowered from the pressing position within a range in which the support member is elastically deformable and is put into a state in which the lever can be lifted together with the lift plate by a bias force of the biasing member in a case when the eccentric cam rotates further from the state in which the boss is locked by the lock part and the boss is unlocked from the lock part.

2. The conveyance unit according to claim 1, wherein the eccentric cam includes:

a first cam surface in slidable contact with the boss of the lever and having an eccentric radius that permits the lever to turn upward; and a second cam surface formed continuously from the first cam surface, in slidable contact with the boss of the lever, and having an eccentric radius that presses the boss and turns the lever downward, and wherein the first and second cam surfaces are continuously formed through the lock part on a side of the cam surface where the eccentric radius is large.

3. The conveyance unit according to claim 1, wherein the driving unit includes:

a transmission mechanism including gears transmitting rotational drive of a driving source to the eccentric cam and a restricting unit configured to restrict the rotation of the transmission mechanism.

4. The conveyance unit according to claim 3, wherein the transmission mechanism includes:

an input gear rotationally driven by the driving unit;

a first gear having two tooth lacked parts and fixed to the eccentric shaft;

a second gear configured to be in contact with a side of the first gear, having two tooth lacked parts, and rotationally attached to the eccentric shaft; and a compression spring connected between the first gear and the second gear, wherein the second gear is provided to be engageable with the input gear, the second gear is provided with a columnar part formed projectively on one end surface thereof, the columnar part is provided with two receded parts on a circumferential surface thereof, and the restricting unit includes a hook member engaged with or disengaged from either one of the two receded parts.

5. The conveyance unit according to claim 1, wherein the arm part of the lever includes an inclined surface having a downward gradient from a tip side of the arm part toward a base end side at a lower side of a tip part of the arm part.

6. The conveyance unit according to claim 5, wherein the support member includes a base part extending downward from a lower surface of the lever body and an extension part extending from a lower end of the base part so as to bend to the lift plate side and being formed into a shape of letter L.

7. The conveyance unit according to claim 6, wherein the extension part declines toward the lift plate side from the base part side so as to be distant from the lower surface of the lever body.

8. An image forming apparatus comprising:

a conveyance unit configured to deliver a sheet toward a conveyance path;

wherein the conveyance unit includes;

a cassette removably attached to an apparatus body;

a conveyance interlocked part provided in the apparatus body so as to be adjacent the cassette;

wherein the cassette includes;

a sheet storage part configured to store the sheet;

a lift plate liftably provided between a lowered position along a bottom plate of the sheet storage part and a raised position separated upward from the bottom plate; and a biasing member configured to bias the lift plate to the raised position so as to cause the sheet on the lift plate to contact with a pickup roller;

wherein the conveyance interlocked part includes:

a lever configured to engage with the lift plate when the cassette is attached to the apparatus body and being liftable together with the lift plate;

a pressing mechanism configured to press the lever downward to keep the lift plate at the lowered position; and a support member provided between the apparatus body and the lever so as to suppress a drop of the lever disengaged from the lift plate when the cassette is detached from the apparatus body, wherein the pressing mechanism includes:

an eccentric cam fixed to an eccentric shaft; and a driving unit configured to rotate the eccentric cam in one direction;

wherein the eccentric cam includes a lock part receded on a surface of the eccentric cam, the lever includes:

a lever body rotatably attached to the apparatus body around a lever turning shaft;

an arm part configured to extend from the lever body toward the lift plate and coming into contact with an upper surface of the lift plate; and a boss provided in the lever body so as to be relatively slidably along the surface;

the support member is formed to be elastically deformable in the lift direction of the lever, the lever is disposed at a pressing position and holds the lift plate in the lowered position when the eccentric cam rotates and the boss is locked by the lock part, and the lever is lowered from the pressing position within a range in which the support member is elastically deformable and is put into a state in which the lever can be lifted together with the lift plate by a bias force of the biasing member in a case when the eccentric cam rotates further from the state in which the boss is locked by the lock part and the boss is unlocked from the lock part.

* * * * *